US007822600B2

(12) United States Patent
Kim

(10) Patent No.: US 7,822,600 B2
(45) Date of Patent: Oct. 26, 2010

(54) METHOD AND APPARATUS FOR EXTRACTING PITCH INFORMATION FROM AUDIO SIGNAL USING MORPHOLOGY

(75) Inventor: Hyun-Soo Kim, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 946 days.

(21) Appl. No.: 11/484,204

(22) Filed: Jul. 11, 2006

(65) Prior Publication Data

US 2007/0106503 A1 May 10, 2007

(30) Foreign Application Priority Data

Jul. 11, 2005 (KR) ..... 10-2005-0062460

(51) Int. Cl.
*G10L 11/04* (2006.01)

(52) U.S. Cl. ..... 704/207; 704/211

(58) Field of Classification Search ..... 704/207, 704/211

See application file for complete search history.

(56) References Cited

U.S. PATENT DOCUMENTS 4,829,574 A * 5/1989 Dewhurst et al. ..... 704/236
6,205,422 B1 * 3/2001 Gu et al. ..... 704/233
7,386,217 B2 * 6/2008 Zhang ..... 386/46
7,454,330 B1 * 11/2008 Nishiguchi et al. ..... 704/224
2003/0204543 A1 * 10/2003 Yoon et al. ..... 708/300
2004/0193407 A1 * 9/2004 Ramabadran et al. ..... 704/207
2004/0260540 A1 12/2004 Zhang
2006/0069559 A1 * 3/2006 Ariyoshi et al. ..... 704/246

* cited by examiner

*Primary Examiner*—Jakieda R Jackson
(74) *Attorney, Agent, or Firm*—The Farrell Law Firm, LLP

(57) ABSTRACT

A function of improving accuracy of the extraction of pitch information in an audio signal including voice and sound signals is implemented. To do this, a morphological operation is used. In detail, an input audio signal is converted to an audio signal in a frequency domain, an optimum structuring set size (SSS) is determined, and a morphological operation is performed using the determined SSS. Then, by extracting the highest peak from a signal obtained through a predetermined fold and summation process as pitch information, the pitch information can be used in all audio systems in the latter part when voice coding, recognition, synthesis, and/or robustness are performed.

20 Claims, 8 Drawing Sheets

METHOD AND APPARATUS FOR EXTRACTING PITCH INFORMATION FROM AUDIO SIGNAL USING MORPHOLOGY

This application claims priority under 35 U.S.C. § 119 to an application entitled "Method and Apparatus for Extracting Pitch Information from Audio Signal Using Morphology" filed in the Korean Intellectual Property Office on Jul. 11, 2005 and assigned Serial No. 2005-62460, the contents of which are incorporated herein by reference.

BACKGROUND OF THE INVENTION

1. Field of the Invention

The present invention relates generally to a method and apparatus for extracting pitch information from an audio signal, and in particular, to a method and apparatus for extracting pitch information from an audio signal using morphology to improve accuracy of the extraction of pitch information.

2. Description of the Related Art

In general, an audio signal including a voice signal and a sound signal is classified into a periodic (harmonic) component and a non-periodic (random) component, i.e., a voiced part and an unvoiced part according to statistic characteristics in a time domain and a frequency domain and is called quasi-periodic. The periodic component and the non-periodic component are determined as the voiced part and the unvoiced part according to the existence or non-existence of pitch information, and a periodic voiced sound and a non-periodic unvoiced sound are identified based on the pitch information. Particularly, the periodic component of the audio signal has the most information and significantly affects sound quality. A period of the voiced part is called a pitch. That is, the pitch information is the most important information in all systems using the audio signal, and a pitch error is an element that most significantly affects total system performance and sound quality.

Thus, the degree of accuracy in detecting the pitch information is an important element to improve the performance of the sound quality. Conventional extraction methods of pitch information are based on linear prediction analysis by which a signal of a latter part is predicted using a signal of a foregoing part. In addition, an extraction method of pitch information to represent a voice signal based on a sinusoidal representation and to calculate a maximum likely ratio using the harmonicity of the voice signal has been popularly used because of its excellent performance.

In a linear prediction analysis method which is widely used for voice signal analysis, the performance of this method is affected according to the order of the linear prediction. If the order is increased to improve the performance, the amount of calculation increases, and the performance is nevertheless improved no more than a certain level. The linear prediction analysis method works only when it is assumed that a signal is stationary for a short time. Thus, in a transition area of a voice signal, the prediction cannot follow the rapidly changed voice signal, resulting in failure.

In addition, the linear prediction analysis method uses data windowing. Consequently, it is difficult to detect a spectral envelope if the balance between resolutions of a time axis and a frequency axis is not maintained when the data windowing is selected. For example, for voice having a very high pitch, the prediction follows individual harmonics rather than the spectral envelope because of wide gaps between the harmonics when the linear prediction analysis method is used. Thus, for a speaker, such as a woman or a child, performance shows a tendency to decrease. Regardless of these problems, the linear prediction analysis method is a spectrum prediction method widely used because of a resolution in the frequency domain and an easy application in voice compression.

However, the conventional extraction methods of pitch information have the possibility of pitch doubling or pitch halving. In detail, to extract accurate pitch information from a frame, the length of only a periodic component having pitch information in the frame must be found. However, two (2) times the length of the periodic component may be wrongly found in the pitch doubling, and one half (½) times in the pitch halving. As described above, since the conventional extraction methods of pitch information have a problem in the pitch doubling and the pitch halving, consideration must be given to the pitch error affecting the total system performance and sound quality.

When the pitch error is generated, a frequency considered as the best candidate is selected using an algorithm. The pitch error is classified into a fine error ratio due to the performance limit of the algorithm and a gross error ratio indicating a ratio of the number of frames causing many errors to the number of total frames. For example, when errors are generated in 5 frames of 100 frames, the fine error ratio is a difference between actual pitch information in the 95 frames and pitch information after a checking process. An error range has a tendency to increase according to an increase of noise. The gross error ratio is obtained from an unrecoverable error of around one period in the pitch doubling and around a half period in the pitch halving.

As described above, the conventional extraction methods of pitch information have a tendency to show the bad performance for the pitch error most significantly affecting the total system performance and sound quality due to the pitch doubling or the pitch halving.

SUMMARY OF THE INVENTION

An object of the present invention is to substantially solve at least the above problems and/or disadvantages and to provide at least the advantages below. Accordingly, an object of the present invention is to provide a method and apparatus to improve accuracy of extraction of pitch information from an audio signal using morphology.

Still another object of the present invention is to provide a method and apparatus for extracting pitch information from an audio signal using morphology to extract the periodicity of harmonic parts using only harmonic peak parts in the audio signal without any assumption for the audio signal.

According to one aspect of the present invention, there is provided a method of extracting pitch information from an audio signal using morphology, the method including when the audio signal is input, converting the input audio signal to an audio signal in a frequency domain; determining an optimum structuring set size (SSS) of a morphological filter performing morphological closing of a waveform of the converted audio signal; performing a morphological operation using the determined SSS; extracting harmonic peaks as the result of the morphological operation; and extracting pitch information using the extracted harmonic peaks.

According to another aspect of the present invention, there is provided an apparatus for extracting pitch information from an audio signal using morphology, the apparatus including an audio signal input unit for receiving the audio signal; a frequency domain converter for converting the input audio signal in a time domain to an audio signal in a frequency domain; a structuring set size (SSS) determiner for determining an optimum SSS of a waveform of the converted audio signal; a morphological filter for performing a morphological operation using the determined SSS; and a harmonic peak extractor for extracting harmonic peaks as the result of the morphological operation and extracting pitch information using the extracted harmonic peaks.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

Figure 1:
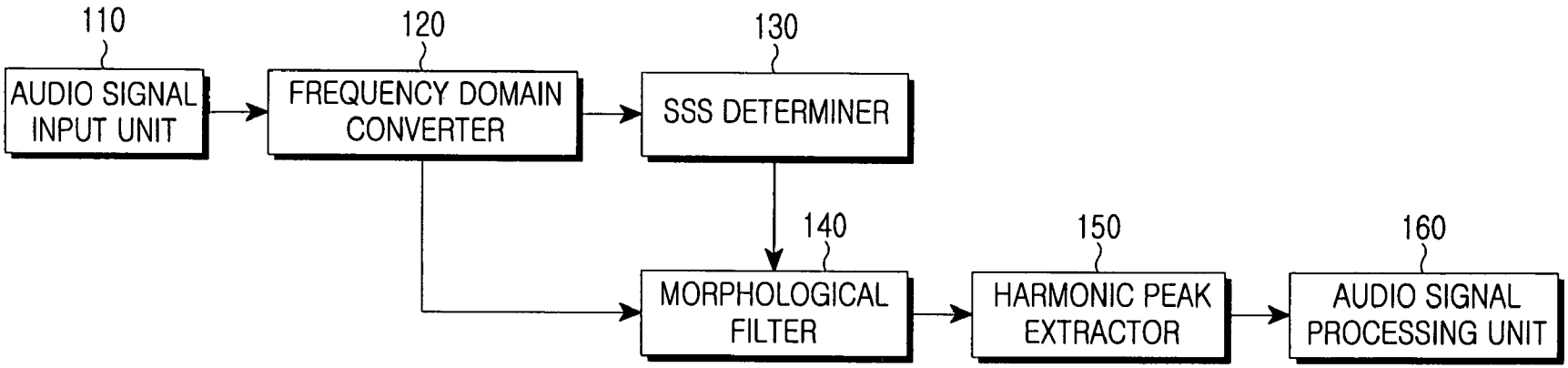
FIG. 1 is a block diagram of an apparatus for extracting pitch information from an audio signal according to the present invention.

Preferred embodiments of the present invention will be described herein below with reference to the accompanying drawings. In the drawings, the same or similar elements are denoted by the same reference numerals even though they are depicted in different drawings. In the following description, well-known functions or constructions are not described in detail since they would obscure the invention in unnecessary detail.

The present invention implements a function of improving accuracy of the extraction of pitch information from an audio signal including voice and sound signals. To do this, the present invention uses a morphological operation. In detail, in the present invention, an input audio signal is converted to an audio signal in a frequency domain, an optimum SSS is determined using the converted audio signal, the morphological operation is performed using the determined optimum SSS, and then, the highest peak is extracted as pitch information from a signal obtained through a predetermined fold and summation process. The extracted pitch information can be used for all audio signal systems in the latter part when performing voice coding, recognition, synthesis, and robustness.

Prior to the description of the present invention, the morphological operation will now be described.

Although the morphological operation used in the present invention is rarely used for processing an audio signal including voice and sound signals, when the morphological operation is used for pitch information extraction, more accurate pitch information can be extracted. In particular, since only harmonic peak parts can be selected using morphological closing, the periodicity of harmonic parts can be extracted only with the harmonic parts, thereby extracting simple, highly accurate pitch information. In addition, since only noise parts can be removed from the selected harmonic parts using the morphological method, the present invention can also be used for noise suppression. Furthermore, the present invention can be used for the degree of voicing measure and voiced/unvoiced classification through the analysis of periodic parts.

As described above, the extraction method of pitch information using the morphological operation according to the present invention can be used for various performance improvement methods, such as zero padding, weighting, windowing, and formant effect elimination. The extraction method of pitch information is robust to noise and rarely shows pitch doubling, pitch halving, and a fine pitch error.

Components and their operations of an apparatus for extracting pitch information from an audio signal, in which the above-described functions are implemented, will now be described with reference to FIG. 1.

Referring to FIG. 1, the apparatus includes an audio signal input unit 110, a frequency domain converter 120, an SSS determiner 130, a morphological filter 140, a harmonic peak detector 150, and a voice processing system 160.

The audio signal input unit 110 can be configured as a microphone and receives an audio signal including voice and sound signals. The frequency domain converter 120 converts the received audio signal from a time domain to a frequency domain.

The frequency domain converter 120 converts an audio signal in the time domain to an audio signal in the frequency domain using fast Fourier transform (FFT). Herein, a zero padding process may be additionally performed to reduce a quantization effect. In this case, a frequency without the pitch doubling or the pitch halving can be estimated more accurately.

Figure 4A:
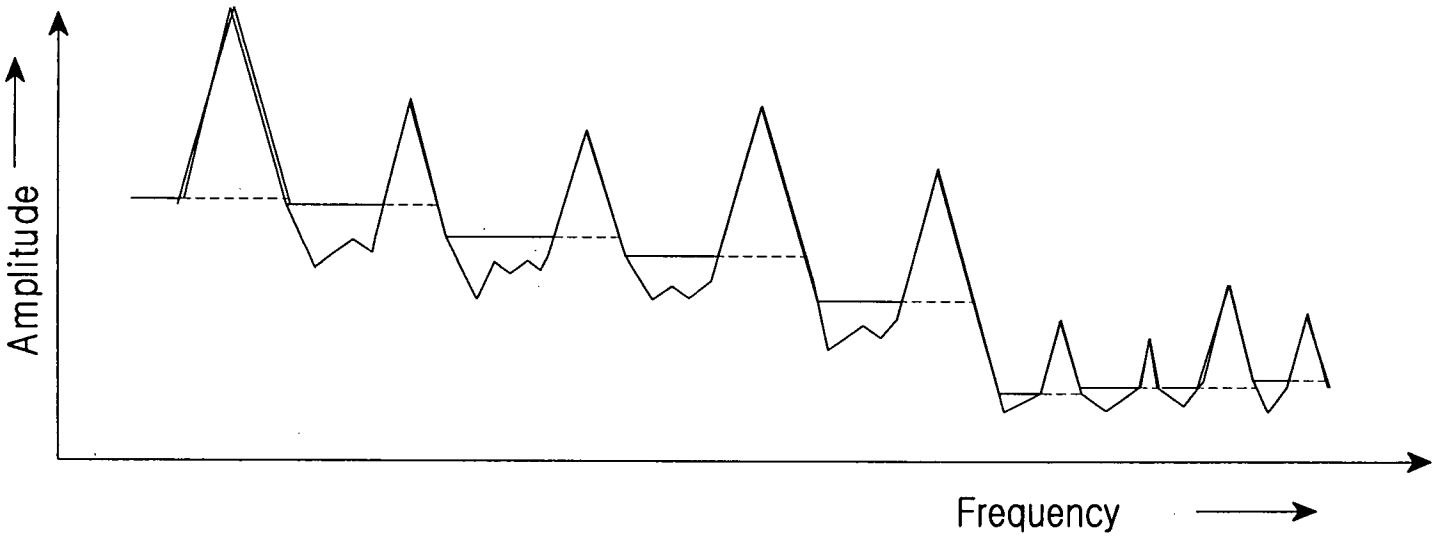
FIGS. 4A and 4B are diagrams of signal waveforms before and after preprocessing according to the present invention.
Figure 4B:
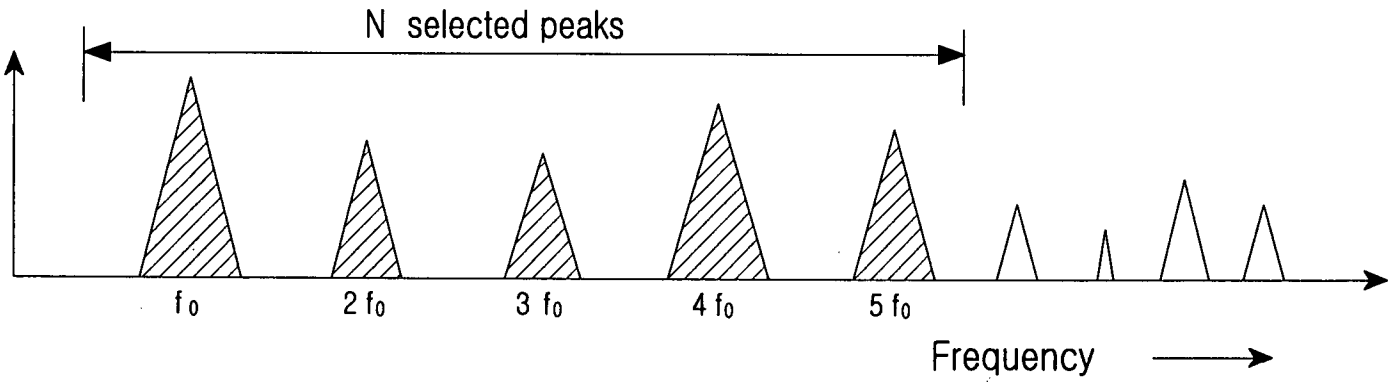

Utilizing the morphological closing, the frequency domain converter 120 selects harmonic peaks. After the morphological closing, a waveform illustrated in FIG. 4A is output. When the waveform illustrated in FIG. 4A is preprocessed, a waveform of a remainder or residual spectrum format is output as illustrated in FIG. 4B. The remainder spectrum indicates a signal existing above a closure floor shown as a dot line in FIG. 4A, and after the preprocessing, only harmonic parts remain as illustrated in FIG. 4B. That is, after the preprocessing, a harmonic signal obtained by removing a staircase signal from the signal output after the morphological closing remains as illustrated in FIG. 4B. Since, the harmonic signal is obtained by selecting harmonics always existing above the closure floor, even if strong noise exists, the harmonic signal can have a characteristic resistant to noise. Through the preprocessing, harmonic content is emphasized in a voiced sound, and a major sinusoidal component is emphasized in an unvoiced sound.

When the frequency domain converter 120 outputs the signal illustrated in FIG. 4B to the SSS determiner 130, the SSS determiner 130 determines an SSS for optimizing the performance of the morphological filter 140. That is, the SSS determiner 130 determines an optimum SSS for the waveform of the converted audio signal in the frequency domain.

In detail, if it is assumed that the number of maximum harmonic peaks, is N, that is, if N peaks corresponding to parts filled with oblique lines in FIG. 4B are defined as the maximum harmonic peaks, then a P value is obtained using the N selected peaks, wherein P denotes a ratio of the energy of the N peaks to the energy of the total remainder spectrum. For example, in FIG. 4B, if N=5 and a value obtained by summing all of the parts filled with oblique lines is $E_N$, which is the energy of the N peaks, and if $E_{total}$ is the energy of the total remainder spectrum, $P=E_N/E_{total}$. By comparing the P value to the SSS in a state where no assumption is granted to the audio signal, the SSS determiner 130 decreases N if the P value is too great (e.g., SSS<0.5) and increases N if the P value is too small (e.g., SSS>0.5). Accordingly, since a pitch of a female speaker is high, the number of total harmonics is less, thereby selecting N smaller than that in the case of a male speaker. Through the above-described process, the optimum SSS of the morphological filter 140 performing the morphological closing of the waveform of the converted audio signal in the frequency domain is determined. Although the process of determining the optimum SSS by adjusting N is used to extract pitch information most easily, the process can be selectively used according to the necessity since an inaccurate SSS does not significantly affect the extraction of pitch information. Consequently, an SSS obtained by starting from the smallest SSS and increasing the SSS value step by step may be used in place of selecting the SSS using N.

The morphological filter 140 performs the morphological operation of the waveform of the audio signal in the frequency domain using the determined SSS. The morphological filter 140 performs the morphological operation utilizing the optimum SSS determined by the SSS determiner 130. Thereafter, the morphological filter 140 performs the morphological closing and the preprocessing of the waveform of the converted audio signal.

The morphological operation is a nonlinear image processing and analyzing method that focuses on a geometric structure of an image. The morphological operation may be performed using a plurality of linear and nonlinear operators in which dilation and erosion, which are first-order operations, and opening and closing, which are second-order operations, are combined. In addition, since the morphological operation is a set-theoretical access method depending on fitting a structuring element to a specific value, then a first-order image structuring element such as a voice signal waveform, is represented by a set of discrete values. Herein, a structuring set is determined by a sliding window symmetrical to the origin, and the size of the sliding window determines the level of performance of the morphological operation.

According to the present invention, the sliding window size is obtained using Equation 1 as follows:

$$\text{Sliding window size}=(SSS*2+1) \quad (1)$$

As shown in Equation 1, the sliding window size depends on the SSS. Thus, the performance of the morphological operation can be controlled by adjusting the SSS. By doing this, the morphological filter 140 performs a dilation or erosion operation and an opening or closing operation using the sliding window depending on the SSS determined by the SSS determiner 130.

The dilation operation is an operation of determining maxima of predetermined threshold sets of an audio signal image as values of relevant sets. The erosion operation is an operation of determining minima of the predetermined threshold sets of the audio signal image as values of relevant sets. The opening operation is an operation of performing the erosion operation after the dilation operation, generating a smoothing effect. The closing operation is an operation of performing the dilation operation after the erosion operation, generating a filling effect.

The harmonic peak detector 150 extracts a harmonic peak of each predetermined threshold set from a discrete signal waveform generated by the morphological filter 140, performs a predetermined fold and summation process, and extracts the highest peak as pitch information. That is, the harmonic peak detector 150 extracts harmonic peaks obtained as a result of the morphological operation and extracts the pitch information using the extracted harmonic peaks.

Figures 5A, 5B, 5C, 5D:
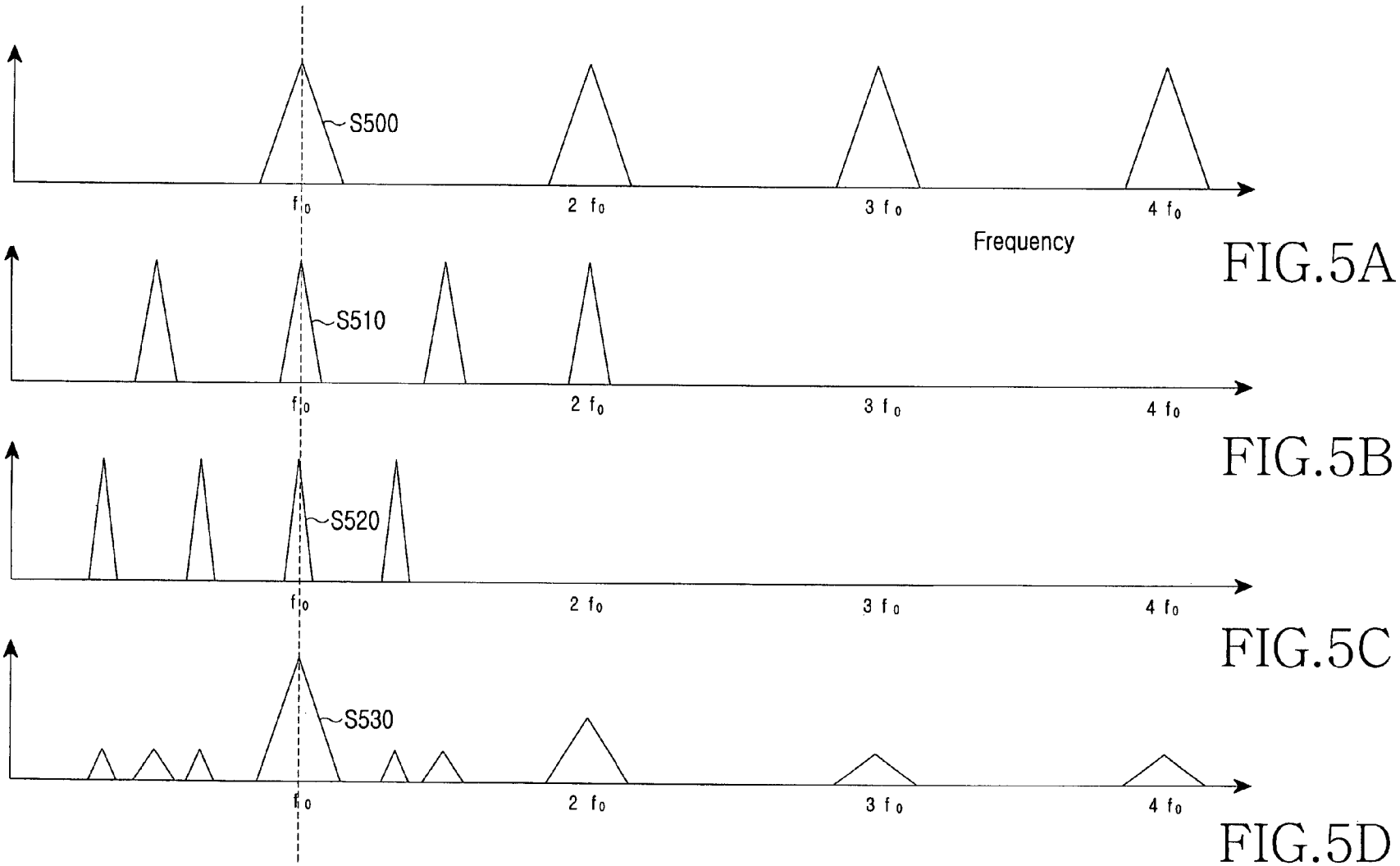
FIGS. 5A to 5D are diagrams are explaining a process of extracting the highest peak of pitch information according to the present invention.

After the harmonic peak detector 150 performs the predetermined fold and summation process, and it can then extract the highest peak in a spectrum obtained through compression as the pitch information. FIGS. 5A to 5D are referred to for purpose of describing this in detail. FIG. 5A illustrates the selected remainder or residual parts, i.e., a signal obtained after the preprocessing as illustrated in FIG. 4B. A signal illustrated in FIG. 5B is obtained when the signal illustrated in FIG. 5A is compressed to one-half (½). For example, $2f_0$ of FIG. 5A becomes $f_0$ of FIG. 5B when the signal illustrated in FIG. 5A is compressed. By passing this signal through a one-third (⅓) frequency compression process and finally summing S500 to S520 existing on a single reference axis, the highest peak S530 of FIG. 5D is obtained. The highest peak S530 is extracted as the pitch information. In the current embodiment, a compression factor indicating the number of compressions is three (3).

When the pitch information is extracted, the voice processing system 160 utilizes the pitch information for coding, recognition, synthesis, and robustness.

A method of extracting pitch information according tithe present invention will now be described. To do this refer to, FIG. 2, which is a flowchart of a method of extracting pitch information from an audio signal according to the present invention, is referred to do this.

Figure 2:
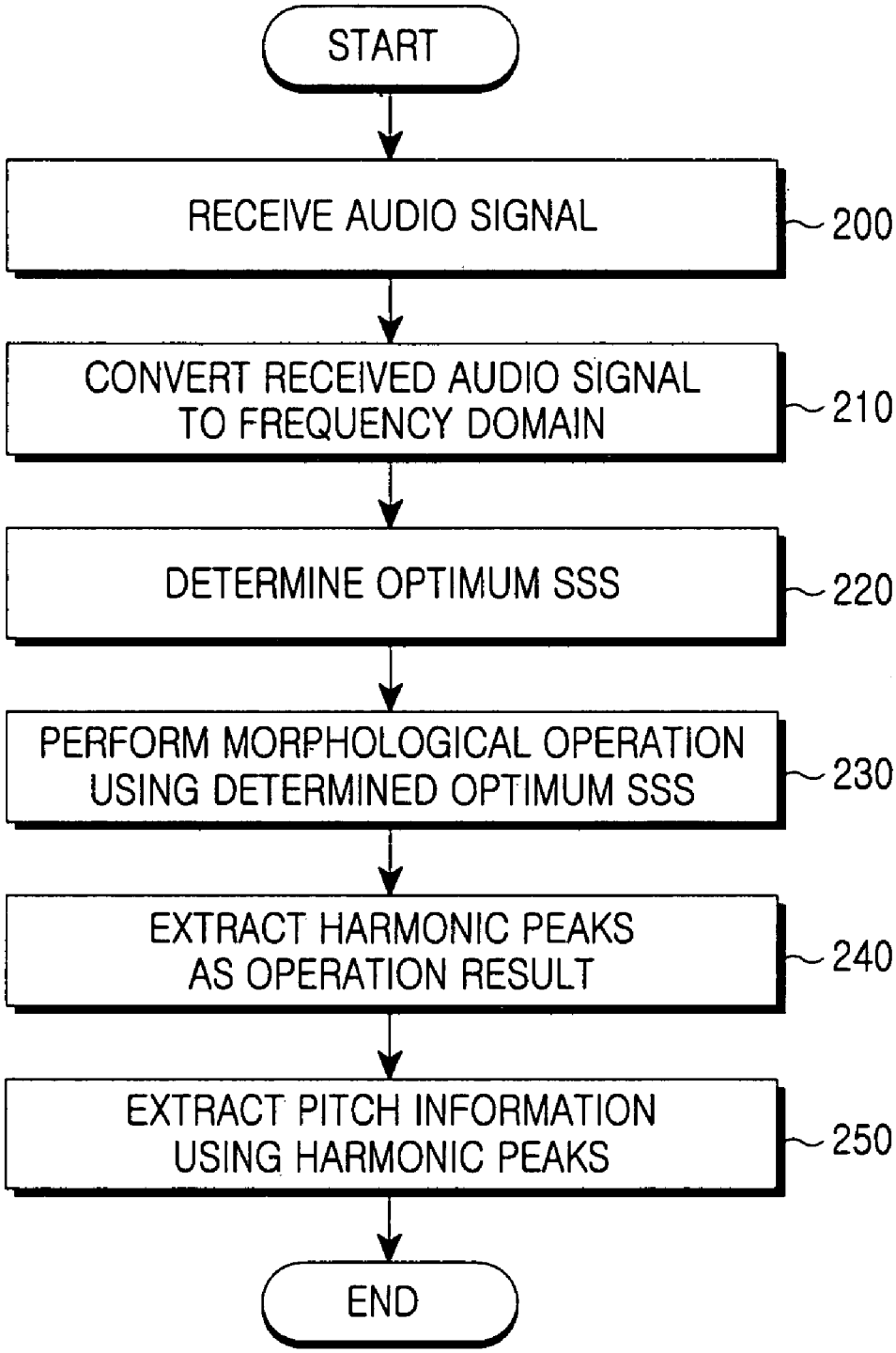
FIG. 2 is a flowchart of a method of extracting pitch information from an audio signal according to the present invention.

Referring to FIG. 2, the extraction apparatus for pitch information receives an audio signal including voice and/or sound signals through a microphone in step 200. The extraction apparatus pitch for information apparatus converts the audio signal in the time domain to an audio signal in the frequency domain using FFT in step 210.

After converting the audio signal in the frequency domain, the extraction apparatus for pitch information determines an optimum SSS for extracting pitch information most easily in step 220. When the optimum SSS is determined, the extraction apparatus for pitch information performs a morphological operation of the waveform of the audio signal in the frequency domain using the determined optimum SSS in step 230. The morphological operation can be achieved through iteration of dilation and erosion, and in a case of an image signal, the morphological operation generates a 'roll ball' effect around an image and have a tendency to smooth corners while filtering the image from the outermost regions.

When the morphological operation is performed, the extraction apparatus for pitch information extracts harmonic peaks as a result of the morphological operation in step 240 and extracts the pitch information using the harmonic peaks in step 250. In detail, after the morphological operation of the audio signal is performed, the extraction apparatus for pitch information extracts the harmonic parts illustrated in FIG. 4B by preprocessing the signal waveform illustrated in FIG. 4A. When the harmonic parts are extracted, the highest peak is extracted by performing predetermined-fold frequency compression and summation of the harmonic parts, and the highest peak is extracted as the pitch information.

Figure 3:
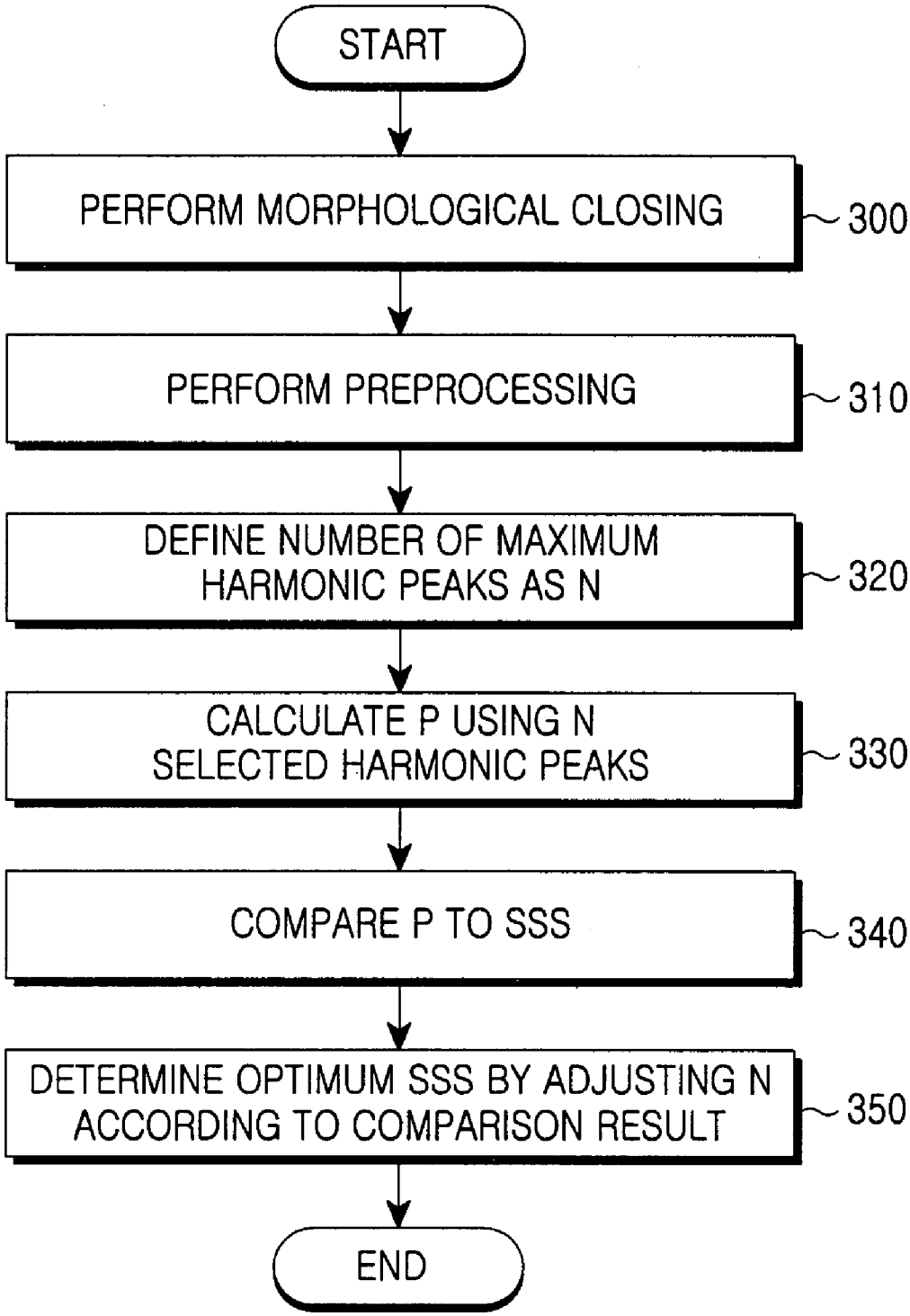
FIG. 3 is a detailed flowchart of a process of determining an optimum SSS of FIG. 2.

While the method of determining an SSS by starting from the smallest SSS and increasing the SSS value step by step is used as described above, however, an optimum SSS to extract more accurate pitch information can be obtained using the algorithm described below. FIG. 3 is a detailed flowchart of the process of determining the optimum SSS in step 220 of FIG. 2

Referring to FIG. 3, when the audio signal in the time domain is converted to the audio signal in the frequency domain, the extraction apparatus for pitch information generates the waveform illustrated in FIG. 4A by performing the morphological closing in step 300. The extraction apparatus for pitch information performs preprocessing of the waveform in step 310. The extraction apparatus for pitch information defines the number of harmonic peaks as N in step 320 and calculates a ratio P of the energy of the N selected harmonic peaks to the energy of the total remainder spectrum using the N selected harmonic peaks in step 330. The extraction apparatus for pitch information compares the P value to a current SSS in step 340 and determines an optimum SSS by adjusting N according to the comparison result in step 350. In other words, If the P value is greater than a predetermined value, N is decreased, and if the P value is smaller than the predetermined value, N is increased. The optimum SSS can be obtained by adjusting N as described above. The SSS is a value for setting a sliding window size for the morphological operation, the sliding window size depending on the performance of the morphological filter 140.

Figure 6:
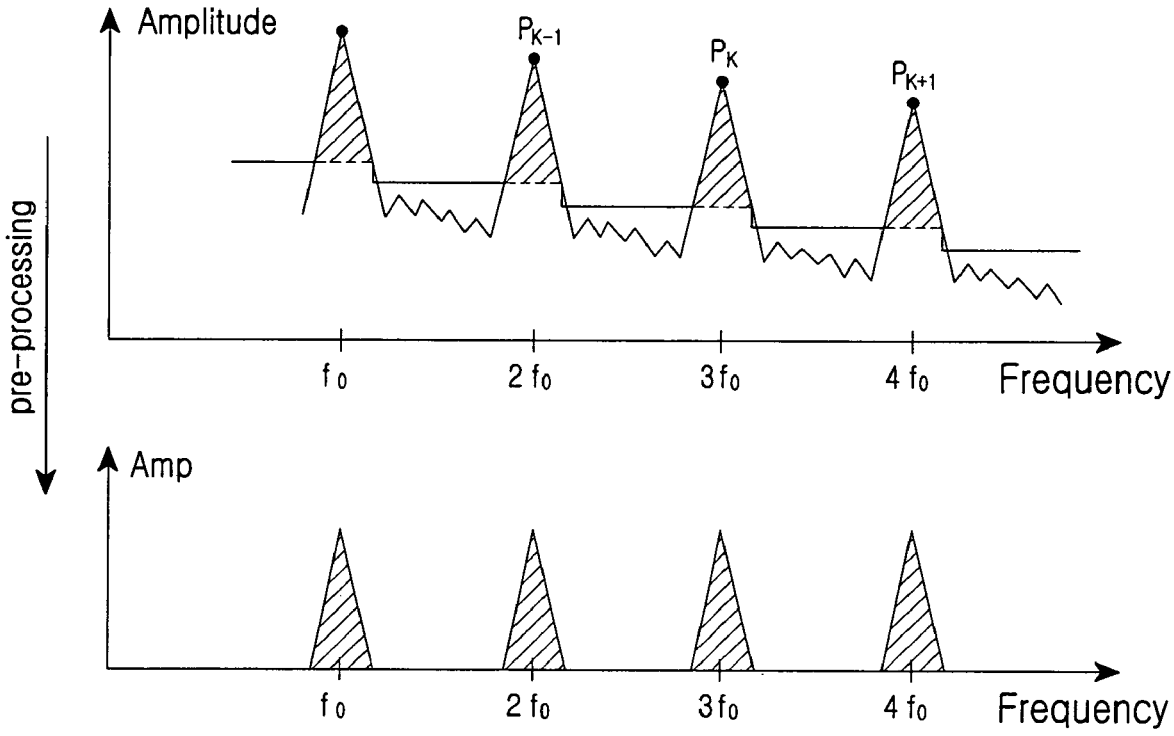
FIG. 6 illustrates a signal waveform obtained after preprocessing an audio signal using morphological closing according to the present invention.

FIG. 6 illustrates a signal waveform obtained after preprocessing an audio signal using the morphological closing according to the present invention. Referring to FIG. 6, when all harmonic peaks exist above the closure floor, the harmonic peaks can be extracted without an exception after preprocessing of an audio signal. In this case, it is not difficult to extract pitch information even if a conventional SSS determination method is used. Thus, the extraction apparatus for pitch information extracts the pitch information using a predetermined SSS.

Figure 7:
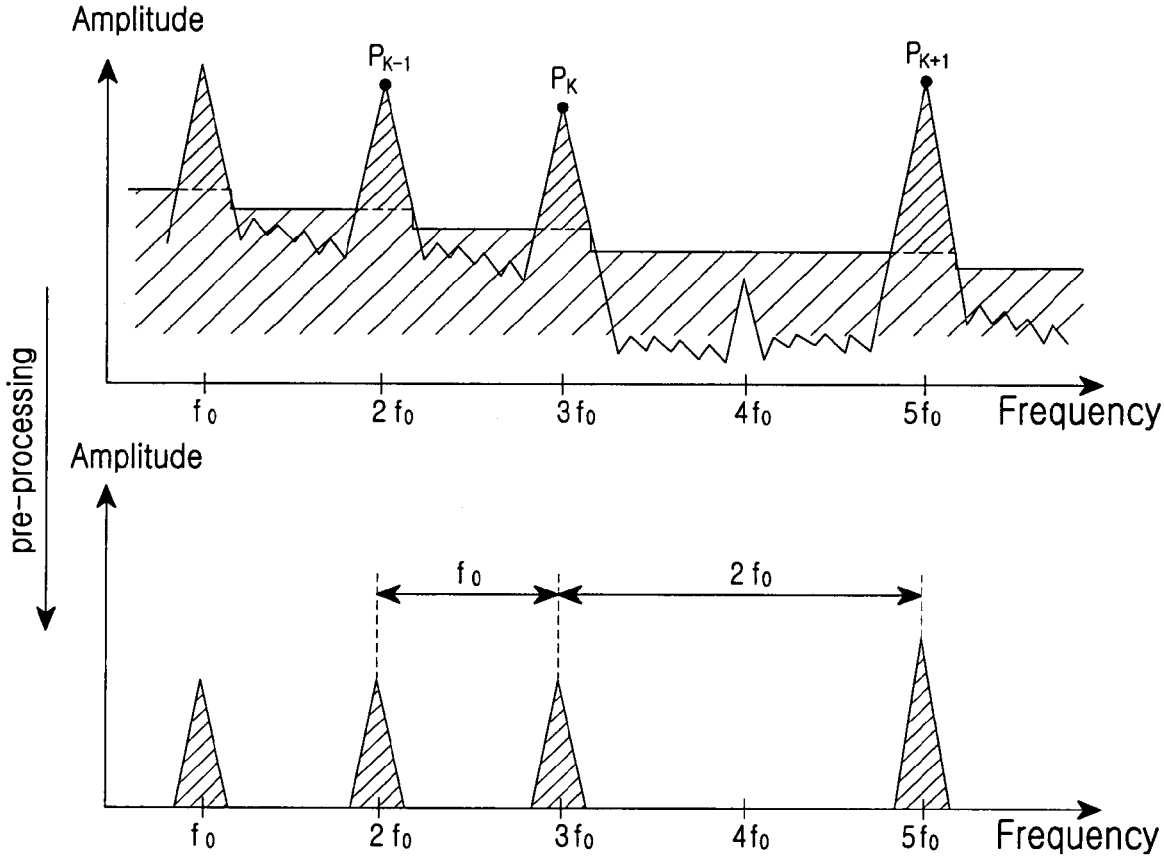
FIG. 7 illustrates another signal waveform obtained after preprocessing an audio signal using morphological closing according to the present invention.
Figure 8:
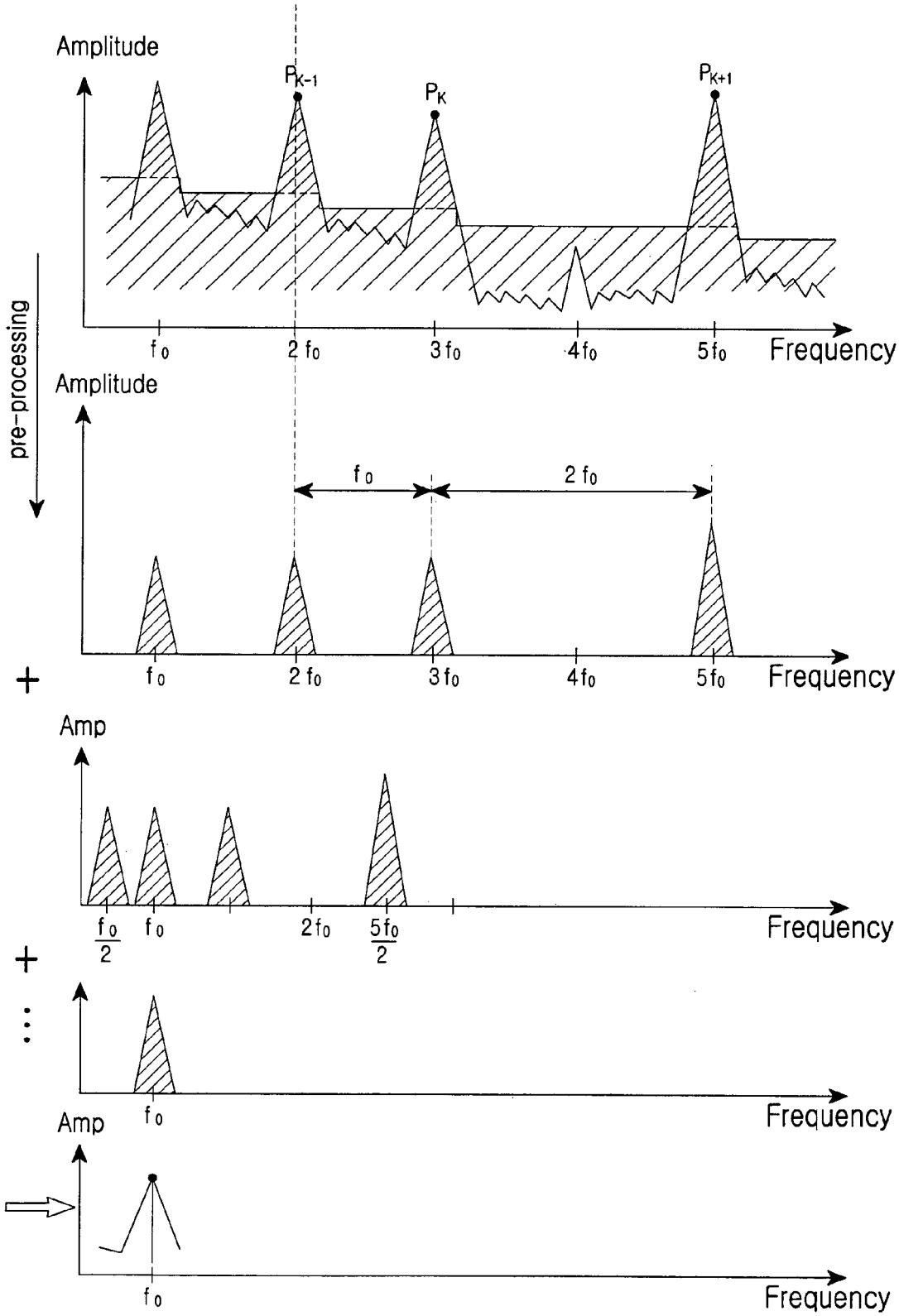
FIG. 8 is a diagram explaining a process of extracting pitch information using a predetermined fold and summation method according to the present invention.

FIG. 7 illustrates another signal waveform obtained after preprocessing an audio signal using the morphological closing according to the present invention. In FIG. 7, one of harmonic peaks exists below the closure floor. This case can occur when noise is severe, and harmonic peaks are extracted except the harmonic peak existing below the closure floor after the preprocessing of an audio signal. If a selected SSS is too great, some harmonic peaks may not be extracted after the preprocessing of an audio signal. However, if a predetermined fold and summation process according to the present invention is performed as illustrated in FIG. 8, the highest peak can be extracted, thereby extracting accurate pitch information.

In the waveforms illustrated in FIGS. 4, 6, and 7, the remainder peaks obtained after the preprocessing of an audio signal are obtained due to a major sine wave component. Thus, extracting pitch information can be accomplished on the basis that pitches are emphasized on the harmonic signals illustrated in FIGS. 5 and 8. To do this, the present invention uses a frequency fold and summation concept used in a harmonic product (or sum) spectrum after the preprocessing is performed.

The harmonic product spectrum is obtained using Equation 2 as follows:

$$\log P(\omega) = \sum_{m=1}^{M} \log|S(m\omega)|^2 = \log\prod_{m=1}^{M} |S(m\omega)|^2 \tag{2}$$

In Equation 2, m denotes the compression factor indicating the number of compressions, and S(ω) denotes a spectrum. Equation 2 is based on that pitch peaks having the same interval are coherently added in a log-spectrum of a harmonic signal. On the contrary, a log-spectrum of the non-harmonic remainder parts is uncorrelated and added uncoherently. Thus, when a pure voiced frame is frequency-compressed, a very sharp major peak of a product spectrum exists in a fundamental frequency, but such a peak does not exist in an unvoiced frame. According to the extraction method of pitch information, a major peak exists in accurate pitch information even if very strong noise is included, thereby having a characteristic very robust to noise. In particular, when the compression factor m is greater than 5, if compression is performed more than 5 times, more accurate pitch information can be obtained.

In general, the entire process is further complicated if compression for constructing a harmonic product spectrum without the preprocessing is performed, for a low frequency of a voice log spectrum (e.g., a formant structure). Although this formant effect can be reduced by removing a spectrum smoothed by a moving average filter from an original spectrum obtained before product spectrum calculation is performed, since the formant effect is removed in advance in a spectrum preprocessed according to the present invention, the formant effect removing process is not necessary. However, a zero padding process can be used to reduce a quantization effect, and a weight function can be used to remove the pitch doubling and the pitch halving. They are used to de-weight spectral parts of a low signal-to-noise ratio (SNR) area, thereby improving a typical voiced spectral shape tapered-off at a high frequency.

For example, for voice, a product (or sum) spectrum can be multiplied by a function of filtering higher than 400 Hz and lower than 50 Hz. In addition, a window, which must be applied to a final product spectrum, grants more weight to a low frequency domain than a high frequency domain. In addition, a window according to a level of an extracted peak can be used, and in this case, it is preferable that power of an original spectrum (e.g., power of 2) be used that the original spectrum. If the extraction method of pitch information extraction method according to the present invention is used, then there is an effect of granting more weight to a high level component than a low level component having the high possibility of corruption due to noise.

Unlike the conventional methods, the extraction method of pitch information according to of the present invention is an extraction method of pitch information, that is practical, simple, and accurate without any assumption or pre-information of an audio signal and its system. Thus, under the extraction method of pitch information according to the present invention, there is no pitch doubling or pitch halving and there exists a minimal fine pitch error.

In addition, although an inaccurate SSS is used, pitch information can be extracted. However, if the method of determining an optimum SSS according to the present invention is used, more accurate pitch information can be extracted. In particular, the preprocessing technique, which is suggested in the present invention, used when the pitch information is extracted using morphology can be applied to other extraction methods of pitch information, and the performance improvement of other systems using the preprocessing technique can be expected because of a signal characteristic (reduced harmonic content and reduced noise) due to the preprocessing. In addition, the preprocessing technique can allow extraction of pitch information by removing the formant effect which can be usefully applied to all systems using an audio signal, and has minimal amount of calculation.

As described above, according to the present invention, by extracting harmonic peaks, which are always output higher than a noise power, using a morphological operation, a method and apparatus for extracting pitch information from an audio signal using morphology is robust to noise, and the amount of calculation is significantly reduced by comparing a current value to a previous or subsequent value and simply extracting only peak information, thereby obtaining a fast calculation speed.

In addition, by using only harmonic peak parts in an audio signal without any assumption, pitch information essential in the audio signal can be easily obtained, and the accuracy of the extraction of pitch information is improved.

In addition, by enabling accurate and quick extraction of pitch information, voice processing can be accurately and quickly performed in actual voice coding, recognition, synthesis, and robustness. In particular, if the present invention is used to devices of which mobility is emphasized, the amount of calculation and a storage capacity are limited, or quick voice processing is required, such as cellular phones, telematics, personal digital assistances (PDAs), and MP3 players, a significant effect can be expected.

While the invention has been shown and described with reference to a certain preferred embodiment thereof, it will be understood by those skilled in the art that various changes in form and details may be made therein without departing from the spirit and scope of the invention as defined by the appended claim

What is claimed is:

1. A method of extracting pitch information from an audio signal, comprising the steps of:

when the audio signal is input, converting, by a frequency domain converter, the audio signal to a frequency domain (b) determining an optimum window size for extracting a pitch from the converted audio signal;

(c) calculating a maximum value and a minimum value of the converted audio signal in optimum window using the determined optimum window size;

(d) checking a variation between the maximum value and the minimum value and generating a staircase signal that has the minimum value in the variation and is used for filtering;

(e) generating a residual signal by extracting the generated staircase signal from the converted audio signal;

(f) generating pitch information by selecting a highest peak generated by performing a predetermined fold and summation process for folding and summing the residual signal; and (g) extracting the pitch information from the residual signal corresponding to the extraction result, wherein the staircase signal includes a plurality of flat signals continuously connected, each flat signal having a constant amplitude in a corresponding optimum window for a morphological operation.

2. The method of claim 1, wherein the input audio signal is one of a voice signal and a sound signal.

3. The method of claim 1, wherein step (b) includes searching on a one-by-one basis from pre-set window sizes.

4. The method of claim 3, wherein the searching step includes adjusting the optimum window size based on a number of peaks selected from a pre-processed audio signal.

5. The method of claim 4, wherein the adjusting includes, after defining the number of the selected peaks as N, calculating a ratio of energy of N selected peaks to remaining non-selected peaks by means of the N selected peaks, and determining an optimum window size by comparing the calculated energy ratio and the selected optimum window size.

6. The method of claim 1, wherein the optimum window size is predetermined according to a type of the input audio signal.

7. The method of claim 1, wherein step (c) includes a dilation operation for calculating the maximum value of the audio signal in a predetermined threshold and an erosion operation for calculating the minimum value of the audio signal.

8. The method of claim 7, wherein step (c) includes an opening operation for smoothing by the dilation operation, followed by the erosion operation, and a closing operation for filling by the dilation operation, followed by the erosion operation.

9. The method of claim 1, wherein step (d) includes generating the staircase signal by repeatedly filtering all of the converted audio signals.

10. The method of claim 1, wherein steps (c) and (d) are repeatedly performed on the input audio signal.

11. An apparatus for extracting pitch information from an audio signal, comprising:

a frequency domain converter for converting an input audio signal in a time domain to an audio signal in a frequency domain;

a determiner for determining an optimum window size for extracting a pitch from the converted audio signal;

a calculator for calculating a maximum value and a minimum value of the converted audio signal in an optimum window using the determined optimum window size;

a filter for checking a variation between the maximum value and the minimum value, generating a staircase signal that has the minimum value in the variation, and extracting the generated staircase signal from the converted audio signal; and an extractor for extracting pitch information from a residual signal corresponding to the extraction result, wherein the staircase signal includes a plurality of flat signals continuously connected, each flat signal having a constant amplitude in a corresponding optimum window for a morphological operation, the residual signal is a signal obtained by removing the staircase signal from the converted audio signal and the pitch information is a highest peak generated by performing a predetermined fold and summation process for folding and summing the residual signal.

12. The apparatus of claim 11, wherein the input audio signal is one of a voice signal and a sound signal.

13. The apparatus of claim 11, wherein the determiner searches on a one-by-one basis from pre-set window sizes.

14. The apparatus of claim 11, wherein the determiner adjusts the optimum window size based on a number of peaks selected from a pre-processed audio signal.

15. The apparatus of claim 14, wherein the adjusting includes, after defining the number of the selected peaks as N, calculating a ratio of energy of N selected peaks to remaining non-selected peaks by means of the N selected peaks, and determining an optimum window size by comparing the calculated energy ratio and the selected optimum window size.

16. The apparatus of claim 11, wherein the optimum window size is predetermined according to a type of the input audio signal.

17. The apparatus of claim 11, wherein the calculator further performs a dilation operation for calculating the maximum value of the audio signal in a predetermined threshold and an erosion operation for calculating the minimum value of the audio signal.

18. The apparatus of claim 17, wherein the calculator further performs an opening operation for smoothing by the dilation operation, followed by the erosion operation, and a closing operation for filling by the dilation operation, followed by the erosion operation.

19. The apparatus of claim 11, wherein the filter further generates the staircase signal by repeatedly filtering all of the converted audio signals.

20. The apparatus of claim 11, wherein each operation in the calculator and the filter are repeatedly performed on the input audio signal.

* * * * *